US005292124A

United States Patent [19]

Carpenter

[11] Patent Number: 5,292,124

[45] Date of Patent: Mar. 8, 1994

[54] WAND GAME APPARATUS

[76] Inventor: Steven A. Carpenter, 3236 Debbie Dr., Hendersonville, N.C. 28739

[21] Appl. No.: 18,148

[22] Filed: Feb. 16, 1993

[51] Int. Cl.[5] ..... A63B 67/14

[52] U.S. Cl. ..... 273/109; 273/440; 273/449

[58] Field of Search ..... 273/108, 109, 118 R, 273/440, 441, 447, 449

[56] References Cited

U.S. PATENT DOCUMENTS

| | | | |
|---|---|---|---|
| 1,972,587 | 9/1934 | Fairchild | 273/109 |
| 2,237,748 | 4/1941 | Schwarzenzer | 273/109 |
| 3,304,090 | 2/1967 | Morris | 273/109 |
| 3,666,268 | 5/1972 | Candusso | 273/109 |
| 4,752,076 | 6/1988 | Gelinas, Jr. | 273/109 X |
| 4,911,446 | 3/1990 | Easterwood | 273/109 |

*Primary Examiner*—Vincent Millin
*Assistant Examiner*—Raleigh W. Chiu
*Attorney, Agent, or Firm*—Leon Gilden

[57] ABSTRACT

A wand game includes a handle having elongate rail members extending from the handle, whereupon a game sphere arranged for rolling along the rails is displaced in adjacency to the handle to a second position spaced from the handle, whereupon the rails are diverging permitting the sphere to fall between the rails, whereupon rapid one hundred eighty degree rotation of the handle and rails is arranged to permit catching of the game sphere to continue rolling of the sphere towards the handle. A modification of the invention includes a trio of rails arranged in a coplanar relationship permitting use of a plurality of game spheres.

4 Claims, 4 Drawing Sheets

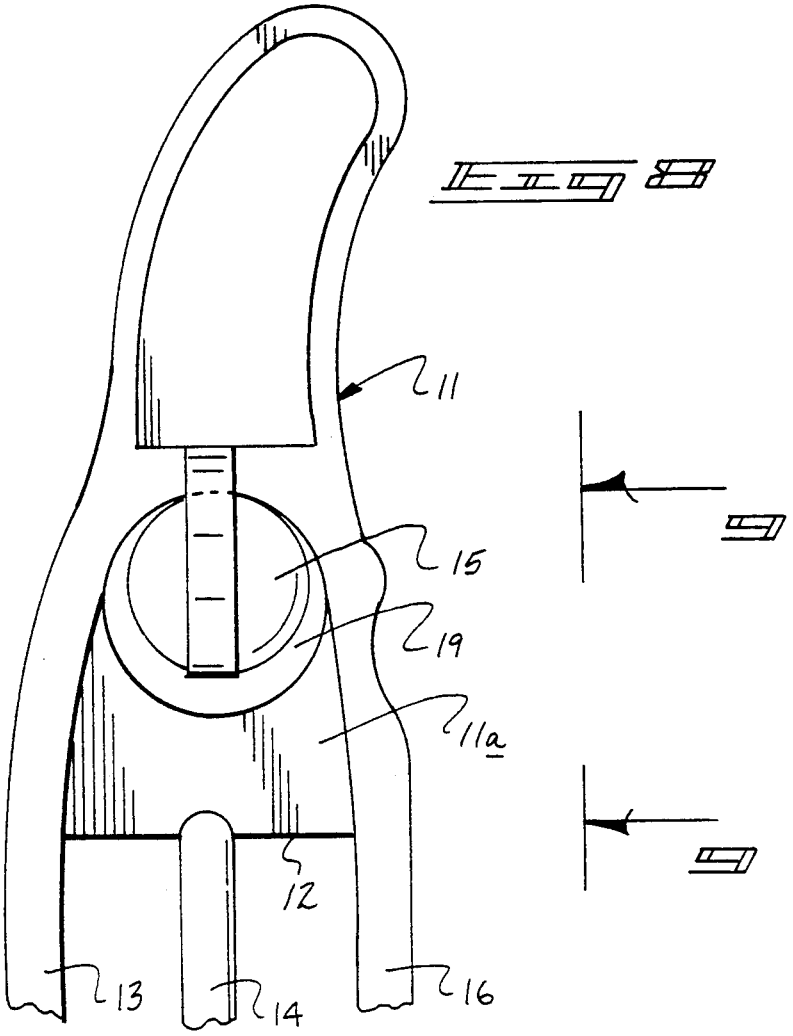
FIG 8
FIG 9
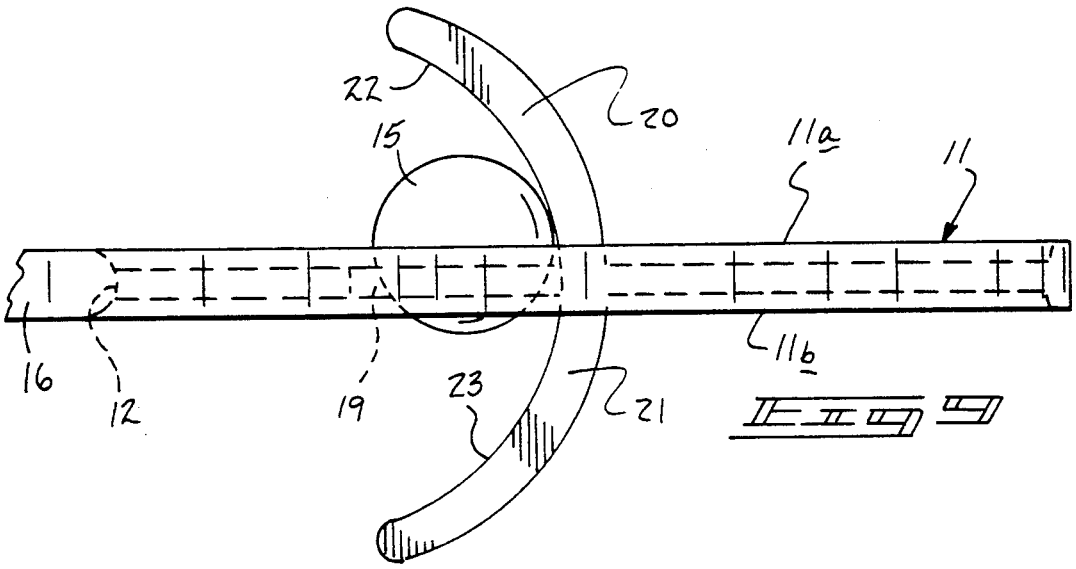
FIG 9

WAND GAME APPARATUS

BACKGROUND OF THE INVENTION

1. Field of the Invention

The field of invention relates to game apparatus, and more particularly pertains to a new and improved wand game apparatus arranged to permit catching of a game sphere that is rotatably directed along the rails of the game apparatus.

2. Description of the Prior Art

Games involving spheres in association with various handle structures are exemplified in the U.S. Pat. No. 4,892,307. U.S. Pat. No. 4,076,238 indicates the use of a handle member arranged to balance a rod having a weighted member at a distal end of the rod.

The instant invention provides for a new and improved wand game apparatus wherein the same is arranged to cooperate with at least one game sphere for the manipulation of the game sphere rotatably along spaced rails of the organization.

SUMMARY OF THE INVENTION

In view of the foregoing disadvantages inherent in the known types of game apparatus now present in the prior art, the present invention provides a wand game apparatus wherein the same is directed to the manipulation of a game sphere and its support rotatably to opposed sides of the elongate rails. As such, the general-purpose of the present invention, which will be described subsequently in greater detail, is to provide a new and improved wand game apparatus which has all the advantages of the prior art game apparatus and none of the disadvantages.

To attain this, the present invention provides a wand game including a handle having elongate rail members extending from the handle, whereupon a game sphere arranged for rolling along the rails is displaced in adjacency to the handle to a second position spaced from the handle, whereupon the rails are diverging permitting the sphere to fall between the rails, whereupon rapid one hundred eighty degree rotation of the handle and rails is arranged to permit catching of the game sphere to continue rolling of the sphere towards the handle. A modification of the invention includes a trio of rails arranged in a coplanar relationship permitting use of a plurality of game spheres.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wand game apparatus which has all the advantages of the prior art game apparatus and none of the disadvantages.

It is another object of the present invention to provide a new and improved wand game apparatus which may be easily and efficiently manufactured and marketed.

It is a further object of the present invention to provide a new and improved wand game apparatus which is of a durable and reliable construction.

An even further object of the present invention is to provide a new and improved wand game apparatus which is susceptible of a low cost of manufacture with regard to both materials and labor, and which accordingly is then susceptible of low prices of sale to the consuming public, thereby making such wand game apparatus economically available to the buying public.

Still yet another object of the present invention is to provide a new and improved wand game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an enlarged orthographic view of a modified handle structure of the invention.

FIG. 9 is an orthographic view, taken along the lines 9—9 of FIG. 8 in the direction indicated by the arrows.

DESCRIPTION OF THE PREFERRED EMBODIMENT

Figure 1:
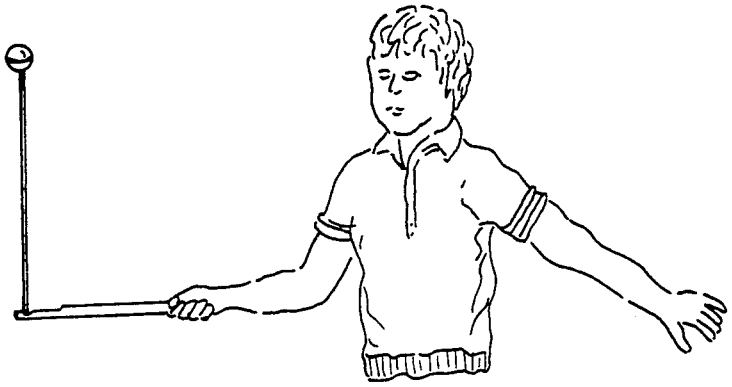
FIG 1 PRIOR ART
FIG. 1 is an orthographic view of a prior art wand game employing a balancing rod, as indicated in U.S. Pat. No. 4,076,238.
Figure 2:
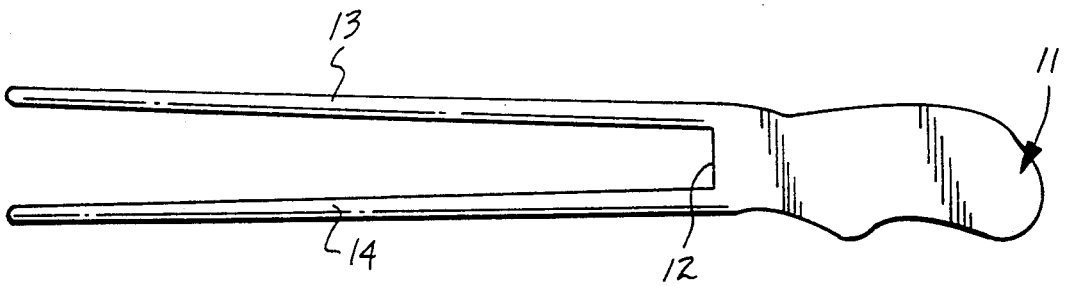
FIG. 2 is an orthographic view of the wand structure of the invention.
Figure 3:
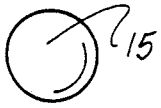
FIG. 3 is an orthographic view of the game sphere of the invention.

With reference now to the drawings, and in particular to FIGS. 1 to 9 thereof, a new and improved wand game apparatus embodying the principles and concepts of the present invention and generally designated by the reference numerals 10 and 10*a* will be described.

Figure 4:
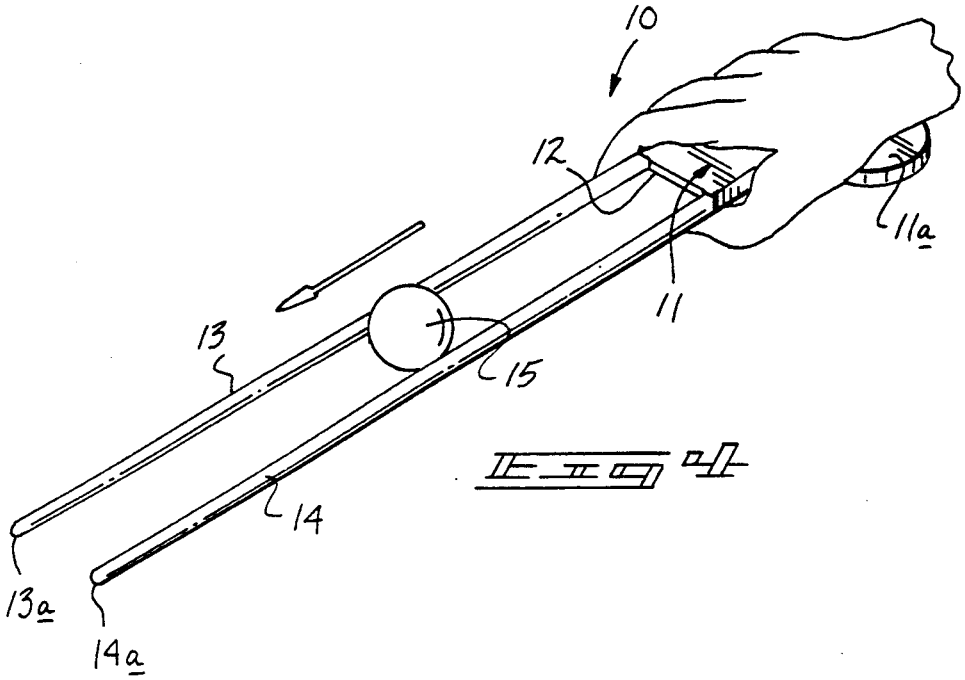
FIG. 4 is an isometric illustration of the apparatus employed in a first position.
Figure 5:
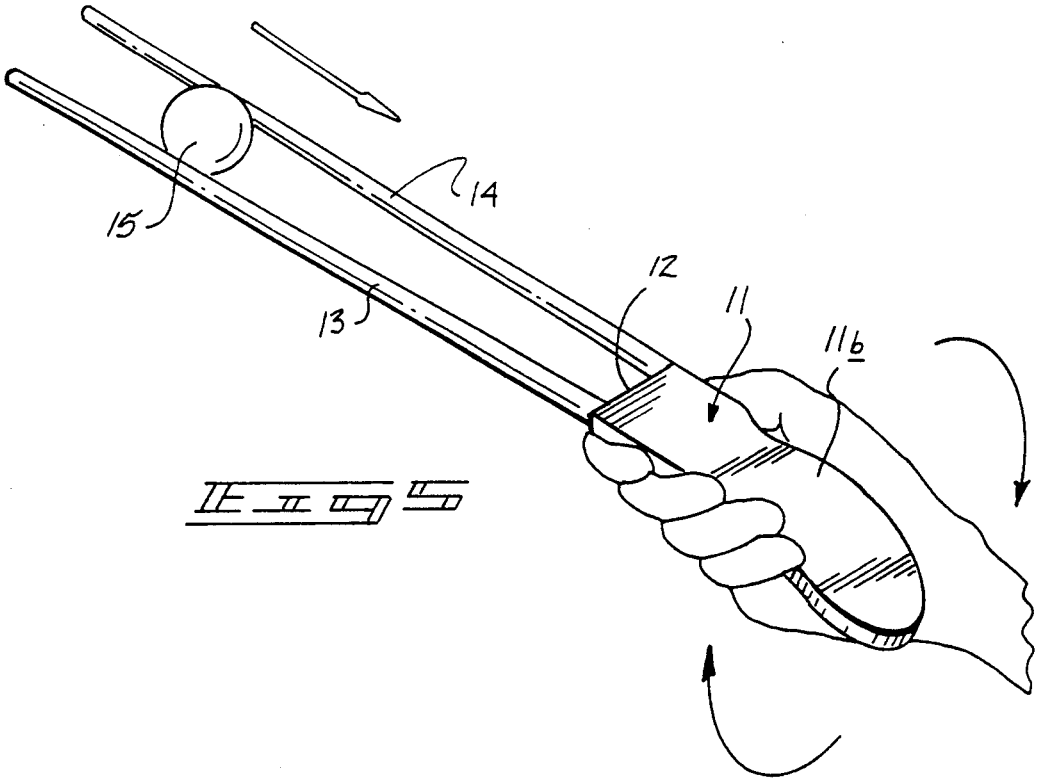
FIG. 5 is an isometric illustration of the invention employed in a second position upon rotation of the wand structure.

More specifically, the wand game apparatus 10 of the instant invention essentially comprises an elongate handle plate 11 having a handle top surface 11*a* spaced from and parallel in a coextensive relationship a handle bottom surface 11*b*. The handle plate 11 includes a handle forward end 12 orthogonally mounting spaced first and second elongate rail members 13 and 14 that are mounted in a coextensive coplanar and substantially diverging relationship to rotatably mount a game sphere 15 therebetween. To this end, the game sphere 15 is defined by a sphere diameter, wherein a first spacing of the first and second rail members 13 and 14 at the handle forward end 12 is less than the sphere diameter, with a second spacing between the first and second leg free distal ends 13*a* and 14*a* of a second spacing greater than the sphere diameter. In this manner, as the game sphere 15 (see FIG. 4) is initiated from the handle forward end 12 rotated towards the rail member free distal ends 13*a* and 14*a*, the game sphere will finally drop through the rails 13 and 14, wherein the object of the game is to effect rapid one hundred eighty degrees of pivoting of the wand structure to resecure the game sphere 15 between the rails 13 and 14. As illustrated in FIG. 4, the handle top surface 11*a* is grasped by the palm to initially position the palm in a face-down relationship, whereupon in a second position, as illustrated in FIG. 5, the palm is in a face-up relationship.

Figure 6:
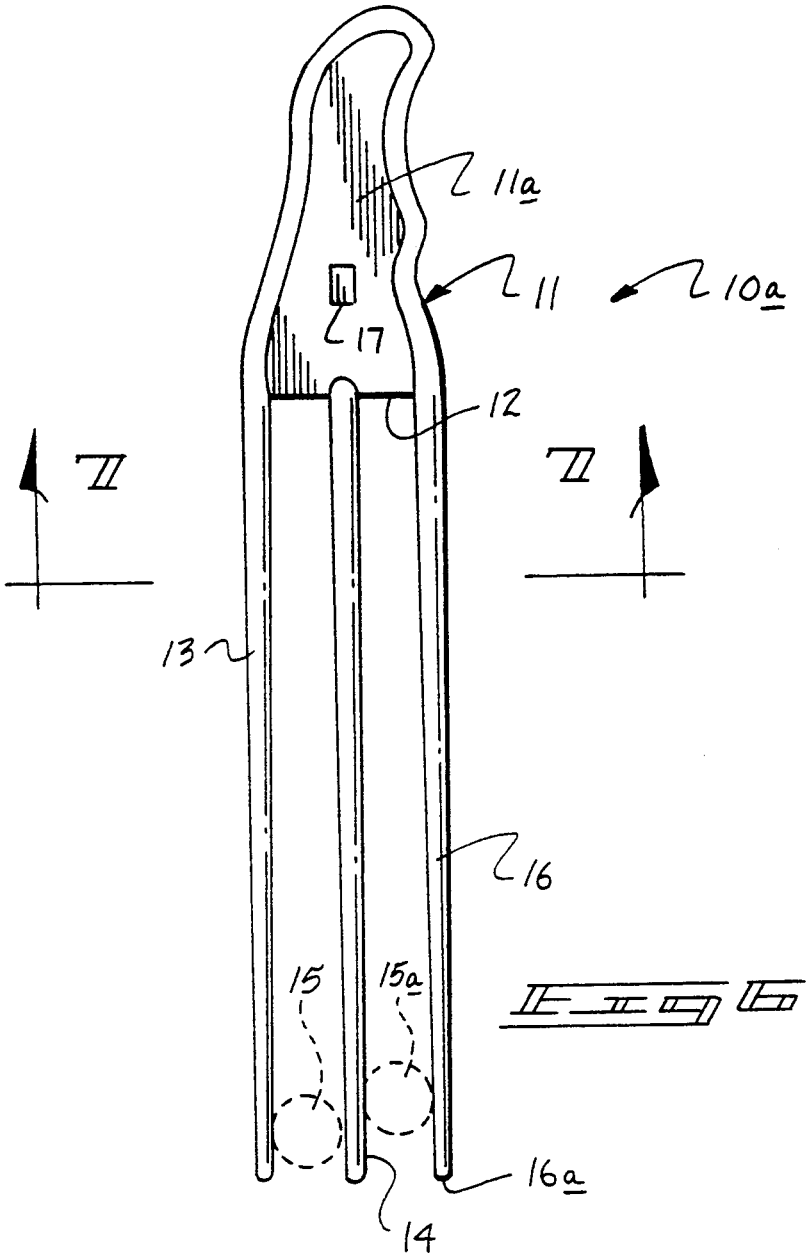
FIG. 6 is an orthographic view of a modified wand structure of the invention.
Figure 7:
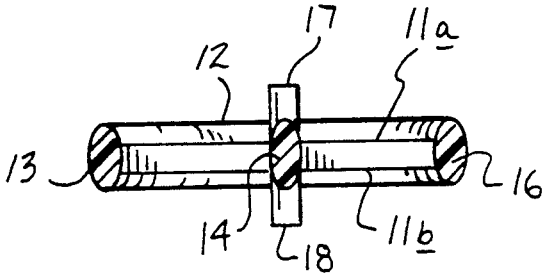
FIG. 7 is an orthographic view, taken along the lines 7—7 of FIG. 6 in the direction indicated by the arrows.

The FIG. 6, as indicated by the apparatus 10*a*, includes the handle forward end 12 including an additional third elongate rail member 16, wherein the third elongate rail diverges from the second elongate rail 14 towards a third rail free distal end 16*a* in a like spacing, as discussed relative to the first and second spacings of the first and second rail members 13 and 14 from the handles forward end 12 to the free distal ends of the rail members. In this manner, a plurality of game spheres may be positioned one between the first and second rail members 13 and 14 and the second game sphere between the second and third rail members 14 and 16, whereupon rapid rotation of the apparatus 10*a* is required to resecure both game spheres, in a manner as indicated in relative to the FIGS. 4 and 5. The first and second game spheres 15 and 15*a* are indicated in phantom in FIG. 6. Further, the handle 11, as indicated in FIG. 6, includes first and second longitudinally aligned abutment legs 17 and 18 orthogonally mounted in an integral relationship extending from the handle top and bottom surfaces respectively, as indicated in FIG. 7, to provide for abutment in rotatably receiving the game spheres along the handle surfaces 11*a* and 11*b*. Further, in the use of a single game sphere with the structure of FIG. 6, the abutment may be employed to assist in redirecting the game sphere from between the first and second rail members to an orientation between the second and third rail members.

The FIGS. 8 and 9 indicate the abutment leg structure indicated as respective first and second arcuate abutment legs 20 and 21, having first and second leg concave interior walls 22 and 23 arranged in a facing relationship towards the handle forward end 12 to permit, in the use of a single game sphere 15, the projecting the game sphere through a handle aperture 19 to direct the game sphere from the handle top surface 11*a* to the handle bottom surface 11*b* and thereby effect rapid reversing of the facing relationship of the handle structure to redirect the game sphere along a spaced pair of the rail members of the rail members 13, 14, and 16.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wand game apparatus, comprising, a wand member, the wand member including an elongate handle plate having a top surface spaced from and coextensive with a bottom surface, and the handle plate including a forward end, and a first and second elongate rail member fixedly and orthogonally mounted to the forward end, wherein the first and second elongate rail members are arranged in a coextensive relationship relative to one another diverging relative to one another, wherein a first spacing is oriented between the first rail member and the second rail member at the forward end, and a second spacing greater than said first spacing is oriented between the first rail member and the second rail member at a first rail member forward distal end and a second rail member forward distal end spaced from the handle forward end, and a game sphere having a sphere diameter greater than said first spacing and less than said second spacing arranged for rotative mounting upon the first rail member and the second rail member, and a third elongate rail member orthogonally and fixedly mounted to the handle forward end, and wherein the third elongate rail member is spaced from the second elongate rail member said first spacing at the handle forward end, and the third rail member including a third rail member forward distal end, and the third rail member forward distal end is spaced from the second rail member forward distal end said second spacing, and wherein the first rail member, the second rail member, and the third rail member are arranged in a substantially coplanar relationship.

2. An apparatus as set forth in claim 1 including an abutment leg fixedly and orthogonally mounted to the handle plate, with the abutment leg including a first leg portion extending from the handle top surface, and a second leg portion extending from the handle bottom surface, wherein the first abutment leg and the second abutment leg are arranged in a spaced relationship relative to the handle forward end permitting abutment of the game sphere directed along the handle plate.

3. An apparatus as set forth in claim 2 wherein the first abutment leg is of an arcuate configuration, and the second abutment leg is of an arcuate configuration, wherein the first abutment leg includes a first leg concave interior wall, and the second abutment leg includes a second leg concave interior wall, wherein the first leg concave interior wall and the second leg concave interior wall are arranged in a facing relationship relative towards the handle forward end.

4. An apparatus as set forth in claim 3 including a handle aperture directed through the handle plate between the first abutment leg and the second abutment leg, and between the first abutment leg, the second abutment leg, and the handle forward end to permit reception of the game sphere therethrough.

* * * * *